US006332325B1

(12) United States Patent
Monfort

(10) Patent No.: US 6,332,325 B1
(45) Date of Patent: Dec. 25, 2001

(54) APPARATUS AND METHOD FOR STRENGTHENING ARTICLES OF MANUFACTURE THROUGH CRYOGENIC THERMAL CYCLING

(75) Inventor: Edward Monfort, Clearwater, FL (US)

(73) Assignee: Coldfire Technolgy, Inc., Largo, FL (US)

( * ) Notice: Subject to any disclaimer, the term of this patent is extended or adjusted under 35 U.S.C. 154(b) by 0 days.

(21) Appl. No.: 09/641,387

(22) Filed: Aug. 17, 2000

(51) Int. Cl.[7] ..... F25D 25/00

(52) U.S. Cl. ..... 62/62; 62/78; 62/457.9

(58) Field of Search ..... 62/62, 78, 457.9

(56) References Cited

U.S. PATENT DOCUMENTS

| | | | |
|---|---|---|---|
| 4,048,836 | | 9/1977 | Eddy et al. . |
| 4,482,005 | | 11/1984 | Voorhees . |
| 4,662,955 | | 5/1987 | Dries et al. . |
| 4,739,622 | * | 4/1988 | Smith ..... 62/78 |
| 5,259,200 | | 11/1993 | Kamody . |
| 5,263,886 | | 11/1993 | Workman . |
| 5,447,035 | | 9/1995 | Workman et al. . |
| 5,865,913 | | 2/1999 | Paulin et al. . |

* cited by examiner

*Primary Examiner*—Ronald Capossela
(74) *Attorney, Agent, or Firm*—Larson & Larson, P.A.; James E. Larson

(57) ABSTRACT

An apparatus for subjecting articles of manufacture to a cryogenic thermal cycling process includes a bottom portion and a lid. The bottom portion comprises an outer and inner tank separated by a plurality of insulation layers. The inner tank defines an inner cavity wherein the articles are subjected to the cryogenic process. A thermal break is provided between the lid and bottom portion so that the temperature of the inner cavity does not conduct to the outer tank of the apparatus bottom portion. The process conducted in the apparatus is controlled by a pre-programmed profile inputted by a key controller or PC. Liquid nitrogen is the preferred cryogenic material to be employed. The novel process subjects the article to extreme negative temperatures thereafter cycling the article between a set of negative temperatures for a number of cycles. The process is completed by heating the article to an extreme positive temperature and then allowed to cool to ambient room temperature. The novel cryogenic thermal cycling process strengthens the article by realigning its molecular structure to eliminate micro-cracking and other manufacturing deforming characteristics.

29 Claims, 10 Drawing Sheets

FIG. 5
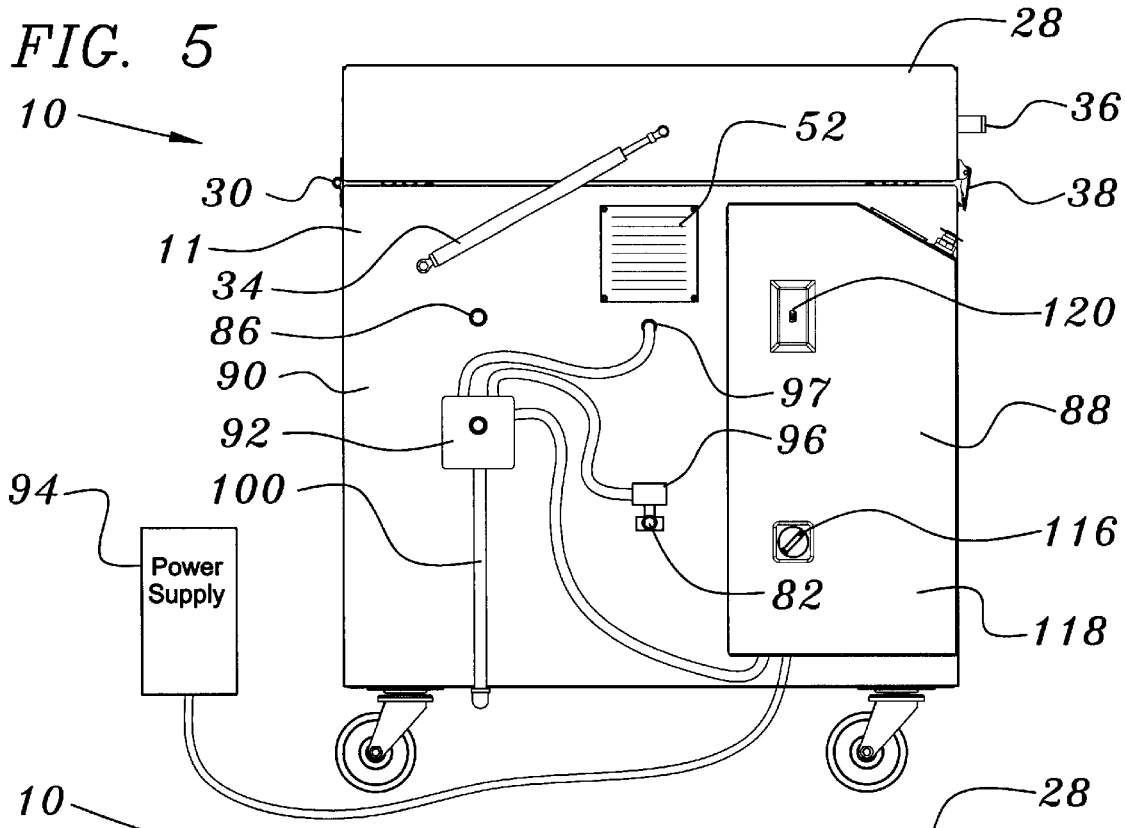
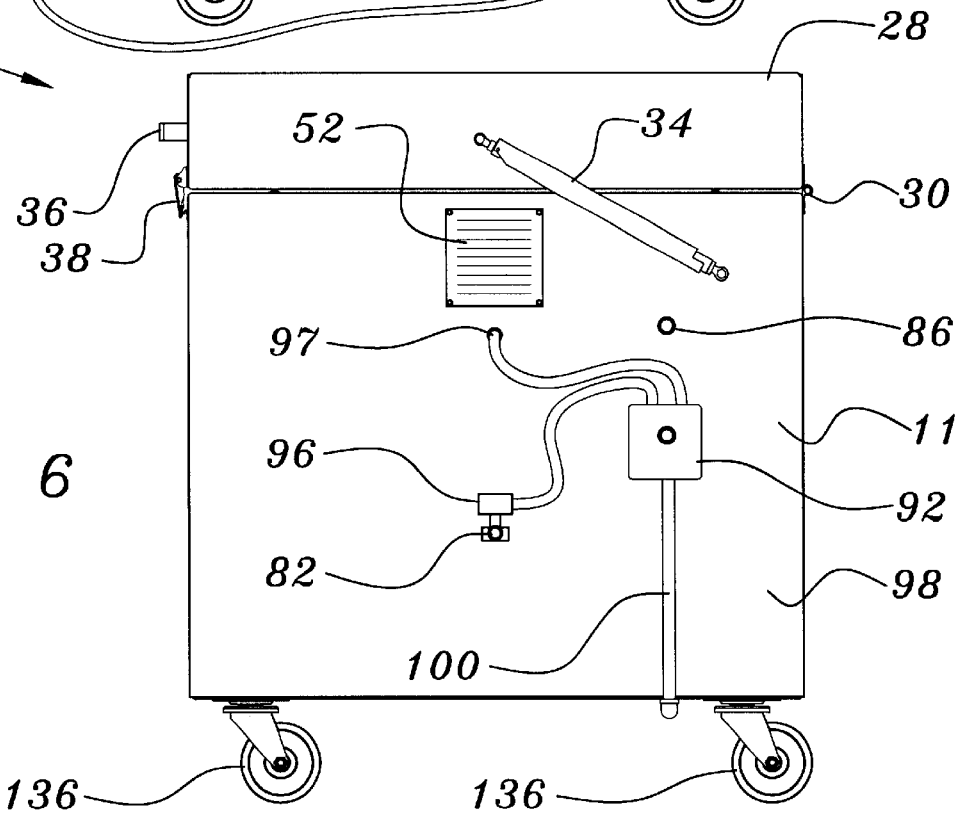
FIG. 6

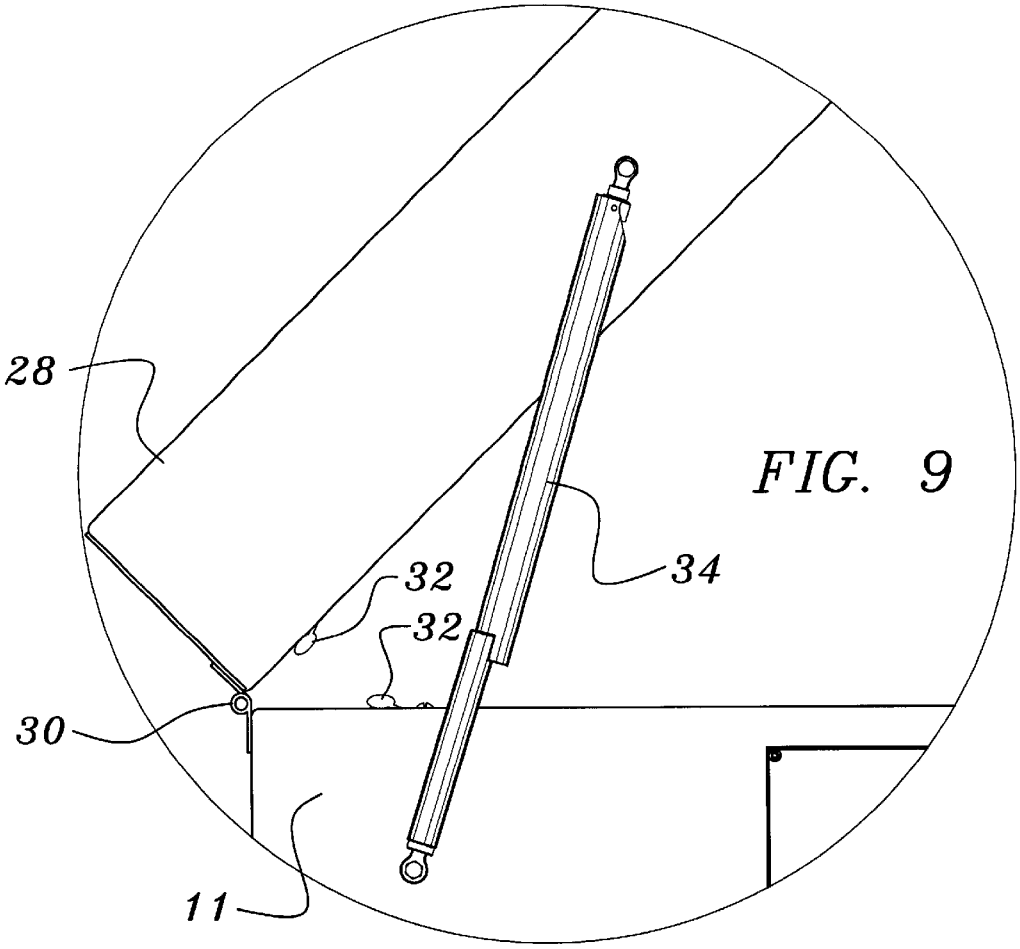
FIG. 9
FIG. 10
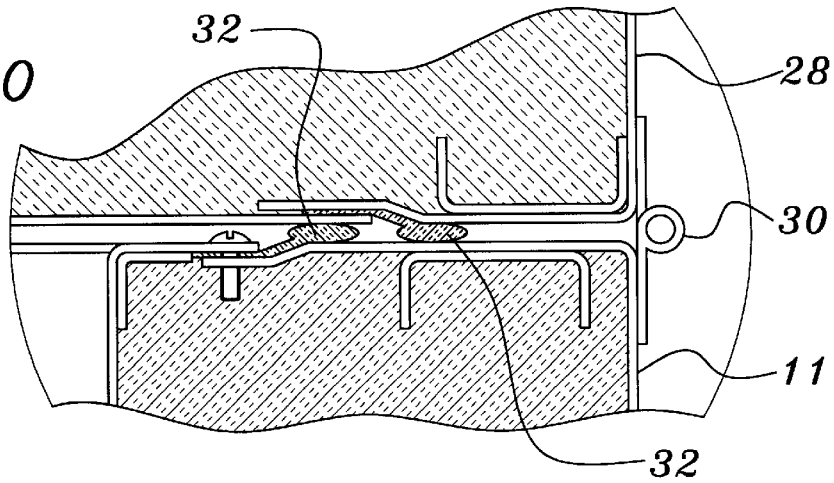

APPARATUS AND METHOD FOR STRENGTHENING ARTICLES OF MANUFACTURE THROUGH CRYOGENIC THERMAL CYCLING

BACKGROUND OF THE INVENTION

1. Field of the Invention

This invention relates to an apparatus and method for strengthening articles of manufacture. More particularly, it relates to an apparatus employing an inert gas or a gas such as nitrogen in a cryogenic thermal cycling process for strengthening the entire mass of articles of manufacture.

2. Description of Prior Art

As energy is dissipated through an article of manufacture, it passes from molecule to molecule causing vibration in the article. Overtime, this vibration weakens the article resulting in premature wear and eventually destruction thereof. Depending on the article, especially those of a metal based molecular structure, and the force being exerted upon it, this premature vibration wear can be costly and in some instances dangerous. For example, if a saw blade is prematurely worn, it could splinter or explode and cause harm to any user or person in close proximity of the exploding blade. It is therefore advantageous to strengthen these articles through molecular transformation or the "bringing together" of the molecules. The concept is to strengthen the article of manufacture by bringing the molecules closer to one another to particulate the molecular structure into smaller micro-structures thereby reducing vibration by creating a more direct path for the dissipating energy. This is especially important in metal articles of manufacture.

Early advances in metal hardening involved heat/quench treatment wherein metal articles where brought to extreme high temperatures and then cooled rapidly. This concept showed some success in the early days of metal hardening but falls well short of the required results needed in today's advanced industry and technology.

Further advances in metal hardening contemplated a simple cryogenic process wherein dry ice was employed. The concept behind this process was that by "freezing" the article, the molecules would be brought closer together. Although the dry ice process showed some further advancement in metallurgical strengthening over that of heat/quenching processes, it is still not a preferred process, mainly due to the inability to have adequate control over temperature changes during the process. Also, at best, the lowest temperature that can be reached with a dry ice process is −180° F. The dry ice process has become known as a shallow cryogenic process. This process also appears to work best only on metal articles and not those of a non metal based molecular structure.

Further advances over the dry ice process were made in metal strengthening cryogenic processes. One example of an improved cryogenic process for strengthening metal articles is a process which employs either an inert gas or liquid nitrogen. This type of cryogenic process showed some improvements over the dry ice process and assisted in correcting newly discovered problems in metal article manufacture.

In addition to vibration problems, it became known that small stress cracks formed within a metal article during the manufacture of the article. By manipulating the temperature of the metal article with a gas it was determined that the article could be relieved of its internal stress cracks and much of the micro-cracking that occurred during manufacture of the article. In doing so, greater integrity would be provided to the metal article, further ensuring that the metal article would wear at a lower degradation rate as compared to those metal articles not subjected to such a process. The end result is a superior metal article of manufacture. Examples of superior metal articles include musical instruments whose tonal quality is improved, strengthened golf club heads which can exert greater force upon a golf ball when it is struck, vehicle components and cutting tools which wear at a slower vibration degradation rate, electronic components which conduct electricity more efficiently and superior machine components for use in satellite and related aerospace technologies which are subjected to extreme low temperatures during employment in space. It should be noted that since nitrogen is considered a safe element to release into the atmosphere, it has become widely used in cryogenic strengthening processes. However, inert gases, such as helium, argon or neon, can also be used.

U.S. Pat. No. 4,048,836 to Eddy et al., a forming and heat treating process, discloses a process wherein one of the numerous steps of the process calls for submersing an aluminum alloy article in a nitrogen atmosphere of −100° F.—a type of cryogenic process. However, this is the only cryogenic step where nitrogen is employed. Further, nowhere in the Eddy process does it contemplate cycling the aluminum alloy article in a nitrogen atmosphere or other cryogenic state at different temperatures for various periods of time. It is merely sub-cooled in the nitrogen atmosphere during a single submersion step. Further, the Eddy process merely contemplates heating the article to a positive Fahrenheit temperature, allowing it to cool in warm water, thereafter bringing the temperature down to −100° F. and then allowing it to return to room temperature. This type of process is representative of many prior art processes which merely raise the temperature of the article once, subsequently allow it to cool to ambient room temperature, thereafter sub-cool it to a negative Fahrenheit temperature and then allow it to finally warm to ambient room temperature—a type of hybrid heat/quench cryogenic process.

Other prior art processes work in an opposite manner to that of the Eddy process as set forth above. In particular, U.S. Pat. No. 4,482,005 to Voorhees discloses a process wherein an ambient room temperature article is first suspended above and secondly then immersed in a liquid cryogenic bath. The liquid cryogenic material is thereafter evacuated such that the article is exposed to a gas. The temperature of the article is brought down to −50° F. over a period of time. Thereafter, the article is brought back to ambient room temperature over a period of time and then brought up to a is permitted to cool back down to ambient room temperature. As disclosed, this process works to first cool the article, thereafter heat the article and then bring it back to ambient room temperature. Nowhere in the Voorhees process is contemplated to thermally cycle the article up and down between a range of temperatures over a period of time.

Recognizing that a process which thermally cycles an article between a range of temperatures provides a superior strength metal article, some inventors have improved upon known processes such as those seen in Eddy and Voorhees. U.S. Pat. No.4,662,955 to Dries et al. is an example of such. In this process, a graphite fiber reinforced aluminum alloy matrix composite panel is heated from an ambient room temperature to about 920–985° F. for about an hour. Thereafter, the panel is cooled with water back down to ambient room temperature. Next, the panel is again heated but to a lower temperature in the range of 300–340° F. for about eight to twenty four hours. The panels are again then allowed to cool to ambient room temperature. Next, the panels are cryogenically cooled to a, temperature of about −268° F. Finally, the panels are permitted to re-warmed to ambient room temperature utilizing ambient air. Although Dries does improved upon the then known processes of metal article strengthening, it falls short of making a major improvement in the art. The use of high temperatures over multiple steps requires extensive power requirements and therefore adds to the cost of employing the process. Further, the Dries invention is limited to a specific composite panel and does not contemplate use with all metal articles of manufacture let alone non-metal based articles. Nowhere in the Dries process is it disclosed to thermally cycling the article at negative Fahrenheit temperatures over various periods of time before heating it to a positive Fahrenheit temperature and then permitting it to cool to ambient room temperature. Further, nothing in Dries suggests running simultaneous processes at different temperatures and/or different time periods.

One of the major deficiencies in prior art processes is that they merely treat the outer surface of the metal article. In other words, these prior art processes fail to treat the entire molecular mass of the metal article. Accordingly, articles treated with the prior art processes cease to be affective after the surface of the metal article has worn away. An improved process is needed which treats the entire mass of the metal article.

The prior art also fails to teach or disclose an apparatus which employs an inert gas or liquid nitrogen cryogenic process which thermally cycles a metal article of manufacture over a wide range of negative Fahrenheit temperatures at different incremental time periods. Further, nowhere in the prior art is it disclosed that a thermal cycling apparatus can be divided by an insulating barrier so that smaller loads can be processed or two loads processed simultaneously at different temperatures and times. Still further, none of the disclosed processes teach a method of treating non-metal based articles of manufacture.

An apparatus and improved method for cryogenic thermal processing is needed which can overcome the deficiencies seen in the prior art. Such apparatus should be self-contained, relatively small is size and easy to operate. The apparatus should be operated by using a microcontroller processing unit, preferably adaptable to communicate with a PC. It would be advantageous for the apparatus to have a large submersion tank which can be divided into two smaller tanks to accommodate small loads or for operation of two simultaneous, yet independent processes. The apparatus should be able to permit the introduction of an in inert gas or liquid nitrogen, be further permitted to convert liquid nitrogen, if used, into a gaseous state and accommodate a wide range of extreme temperatures. Accordingly, proper insulation of the submersion tank is needed. The apparatus should also be able to introduce the inert gas or nitrogen in an efficient manner using an assembly, such as a sparger assembly. Finally, the apparatus should further be able to operate an improved cryogenic thermal cycling process which has not be seen heretofore. Such process should incorporate steps which thermally cycle articles of manufacture to extreme negative temperatures over numerous cycles and time periods and at graduating rates.

SUMMARY OF THE INVENTION

I have invented an apparatus and an improved method for cryogenically treating articles of manufacture for the purpose of strengthening them. My apparatus uses a novel method of cryogenic thermal cycling which strengthens the articles and alleviates vibration (micro-cracking) therefrom. This is accomplished by thermally cycling the article through a series of negative temperature changes prior to ramping the article to a positive Fahrenheit temperature and eventually cooling the article back to ambient room temperature. My process treats the entire mass of the article and not just the surface area. The hardness of the treated article is unaffected so there is less tendency for the article to crack or chip as compared to those articles treated with processes of the prior art. My process realigns the molecules of the treated article such that dissipated energy passing through the article takes a direct path thereby reducing vibration to a non-critical level. My process can also accomplish particle and grain reinforcement and molecular dislocation modification. The results of my process provide an article having greater toughness, wear resistance and durability as well as providing greater fatigue strength and vibration dampening.

My process can treat a wide variety of materials, including but not limited to, ferrous and non-ferrous metals and alloys, carbides, nylons, polymers and ceramics. My process is computer controlled, therefore optimal thermal cycling can be achieved depending on the article being treated.

My apparatus includes an outer and inner tank separated by a void which is filled with a series of insulating layers. A set of sparger assemblies are enclosed within the inner tank and disposed at opposed ends for introducing a cryogenic material such as liquid nitrogen in a preferred embodiment. The inner tank can be separated by a barrier such that two independent loads can be simultaneously operated or for permitting a single small load to be treated. The outer tank rests upon a set of casters which permits the apparatus to be easily moved around a work environment. The casters have locking mechanisms for positioning the apparatus in a desired set position. A lid covers the two tanks and pivots on a continuous piano-type hinge. A set of brace members permit the lid to remain in an open position when desired. A set of adjustable clamps latch the lid to a bottom portion of the apparatus and permit the lid to expand slightly due to fluctuating temperatures during the process.

The cryogenic material is introduced through ports connected to a supply tank, such as a tank of liquid nitrogen. A set of fans are provided for evacuating the cryogenic material during the process and for purging all oxygen from the tank prior to initiating the process. Once an article is placed into the inner tank and the lid is shut and secured, the cryogenic material is introduced into the inner tank. The temperature of the introduced nitrogen can be lowered to −320° F. thereby turning the liquid nitrogen into a gaseous state. The apparatus cycles the temperature up and down for an average of six cycles. The last cycle ramps the temperature to about +400° F. Thereafter the nitrogen is evacuated by the fans into the ambient air through a set of exit ports. A controller electrically coupled to the apparatus can be pre-programmed to carry out the process and can manipulate the cycles, the temperature rate changes as well as the actual temperatures. The controller can be programmed by using its keys or by communicating with a PC.

BRIEF DESCRIPTION OF THE DRAWINGS

The invention may be best understood by those having ordinary skill in the art by reference to the following detailed description when considered in conjunction with the accompanying drawings in which:

FIG. 5 is a left side elevational view of the thermal cycling apparatus;

FIG. 6 is a right side elevational view of the thermal cycling apparatus;

FIG. 9 is a detail view of a brace member used to support a lid portion of the thermal cycling apparatus;

FIG. 10 is a detail view taken from FIG. 8 illustrating a hinge mounted between the lid portion a main tank portion and a bead seal portion of the thermal cycling apparatus;

DETAILED DESCRIPTION OF THE INVENTION

Figure 1:
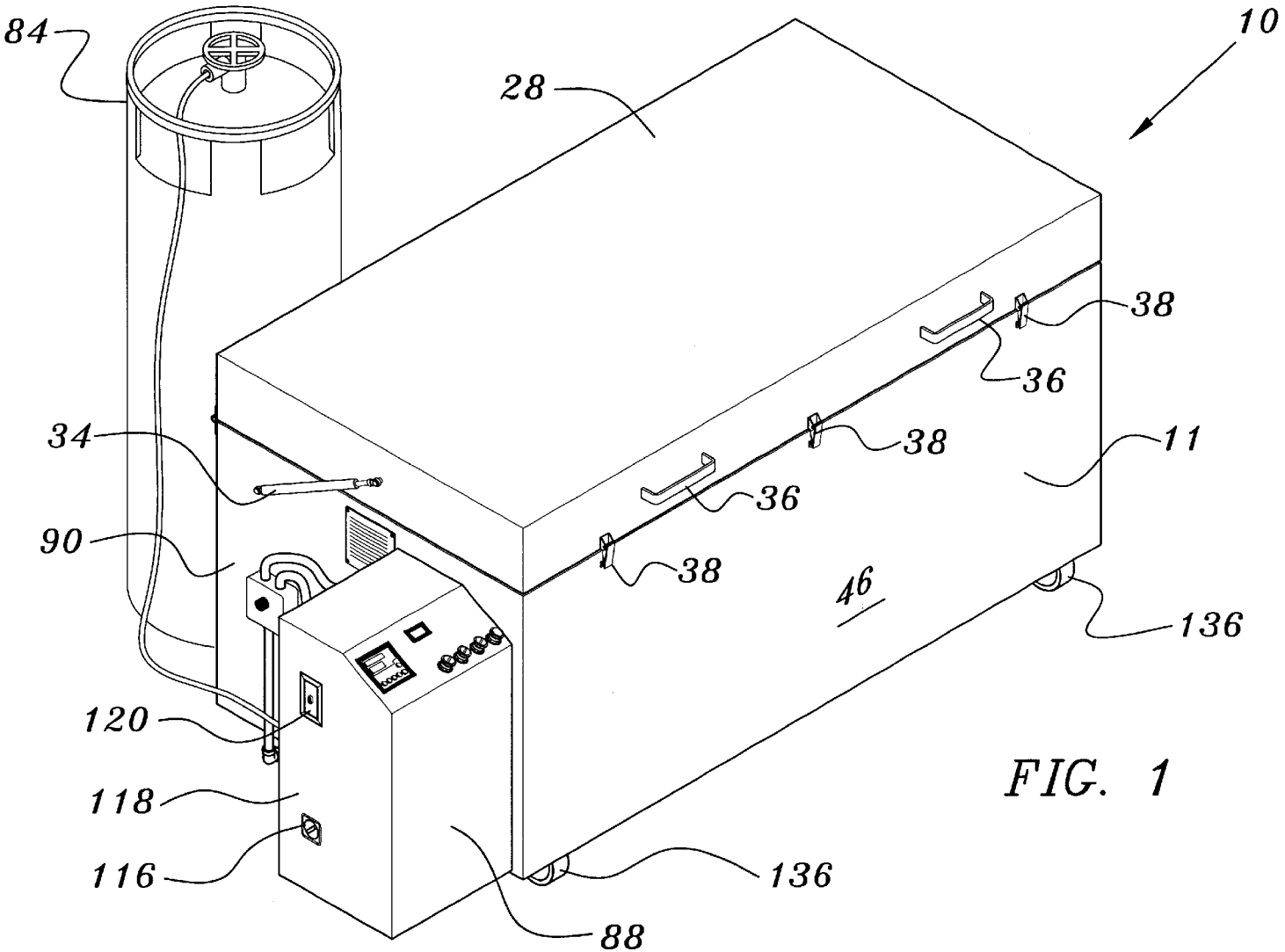
FIG. 1 is a perspective view of a thermal cycling apparatus of the present invention.

Throughout the following detailed description, the same reference numerals refer to the same elements in all figures.

Figure 7:
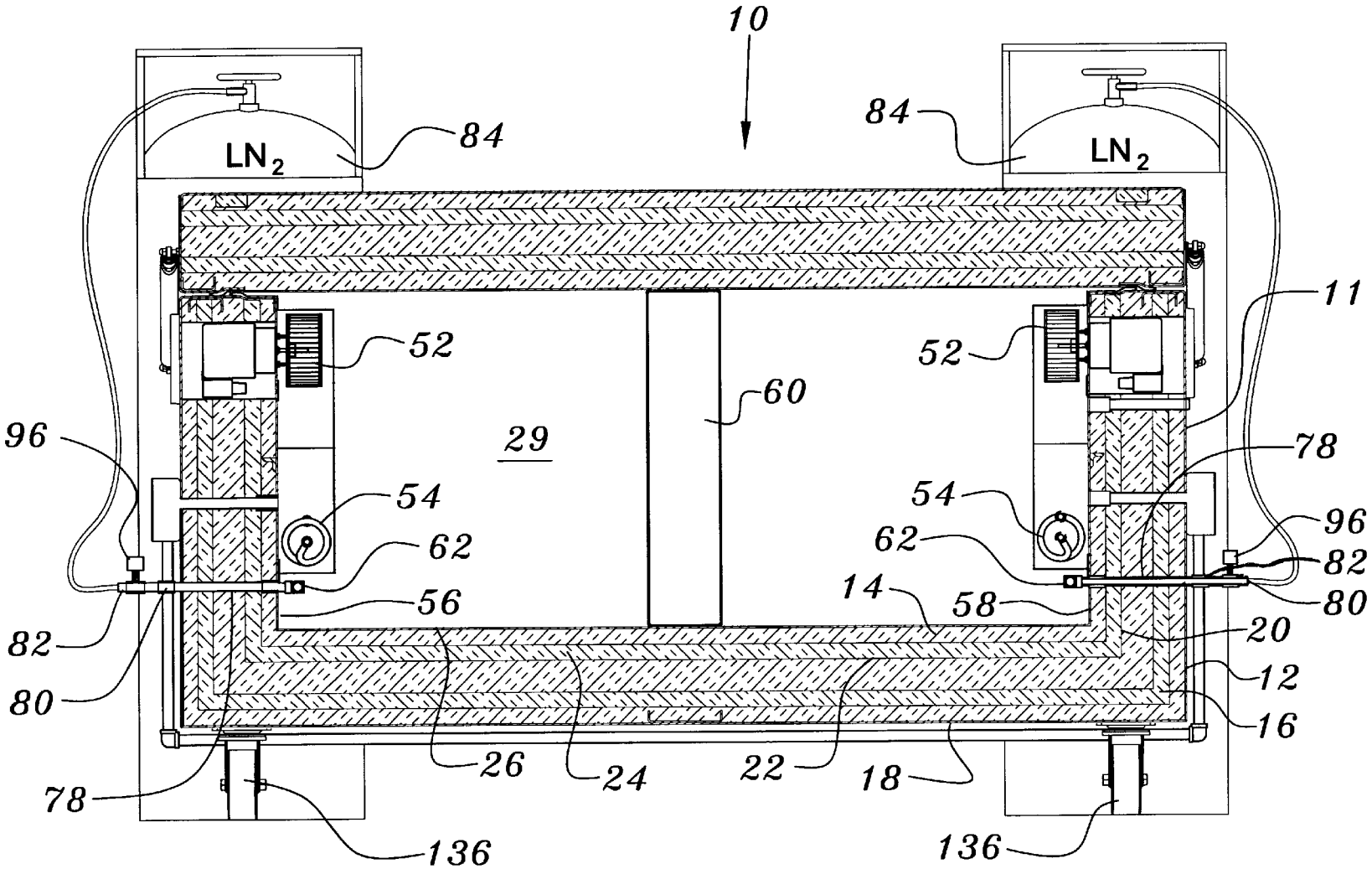
FIG. 7 is a cross-sectional view of the thermal cycling apparatus taken along lines 7—7 of FIG. 4.

Referring to FIG. 1, a cryogenic thermal cycling apparatus 10 of the present invention is shown. As shown in FIG. 7, apparatus 10 includes a bottom portion 11 which comprises an outer tank 12 and an inner tank 14 separated by an insulating void, which in a preferred embodiment is filled with a series of insulting material layers. The series of material layers include a blueboard layer 16 positioned upon a stainless steel shell 18 of outer tank 12. Blueboard layer 16 can be built up from a plurality of blueboard layers or be comprised of a single blueboard layer. For instance, blueboard layer 16 could include two one"layers. Or, as shown in FIG. 7, a single two"layer can be employed. Next, a high density layer of foam 20 is positioned next to blueboard layer 16 providing a tight seal between inner and outer tanks 14 and 12 respectively of apparatus bottom portion 11. Thereafter, a thin layer of aluminum tape 22 is laid upon foam layer 20, providing a moisture barrier between foam layer 20 and inner tank 14. Next, a fire proof insulation layer 24 is positioned upon aluminum tape layer 22. In the preferred embodiment, kaowool (a ceramic-fiber insulator) is employed for fire-proof insulation layer 24. Finally, a stainless steel shell 26 of inner tank 14 positions upon fire proof insulation layer 24. In an alternate embodiment, the insulating void could be a vacuum jacket.

Figure 4:
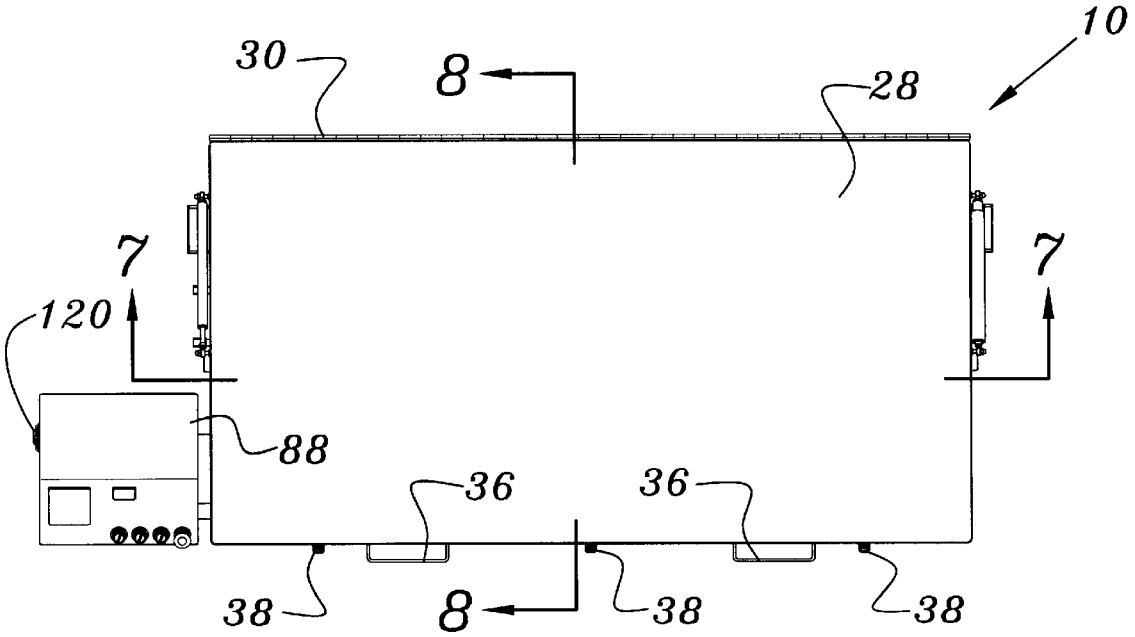
FIG. 4 is a top plan view of the thermal cycling apparatus.

Referring to FIGS. 5 and 6, apparatus 10 includes a lid 28 which seals an inner cavity 29 (see FIG. 7) of inner tank 14 when lid 28 lays upon apparatus bottom portion 11 and is secured shut. As shown in FIG. 7, lid 28 is constructed in the same manner as apparatus bottom portion 11. As shown in FIGS. 4, 9 and 10, lid 28 pivots upon a continuous metal hinge 30 which does not expand in response to extreme temperature changes, thereby precluding leaks between lid 28 and bottom portion 11 of apparatus 10 when lid 28 mates with bottom portion 11. In the preferred embodiment, hinge 30 is a piano-type hinge.

With reference to FIGS. 9 and 10, a pair of bead members 32 are disposed upon both bottom portion 11 and lid 28 and provide a thermal break between lid 28 and bottom portion 11. Bead member 32 is made from a pliable fiber such as those commonly used in the fabrication of robe. When lid 28 is shut, bead members 32 ensure that no heat conduction occurs between the stainless steel metal of bottom portion 11 and lid 28. As seen in FIG. 10, with lid 28 shut, none of the metal of bottom portion 11 is in direct contact with the metal of lid 28. As such, outer tank 12 remains at ambient room temperature regardless of the temperature within inner cavity 29 and that of inner tank 14.

Figure 2:
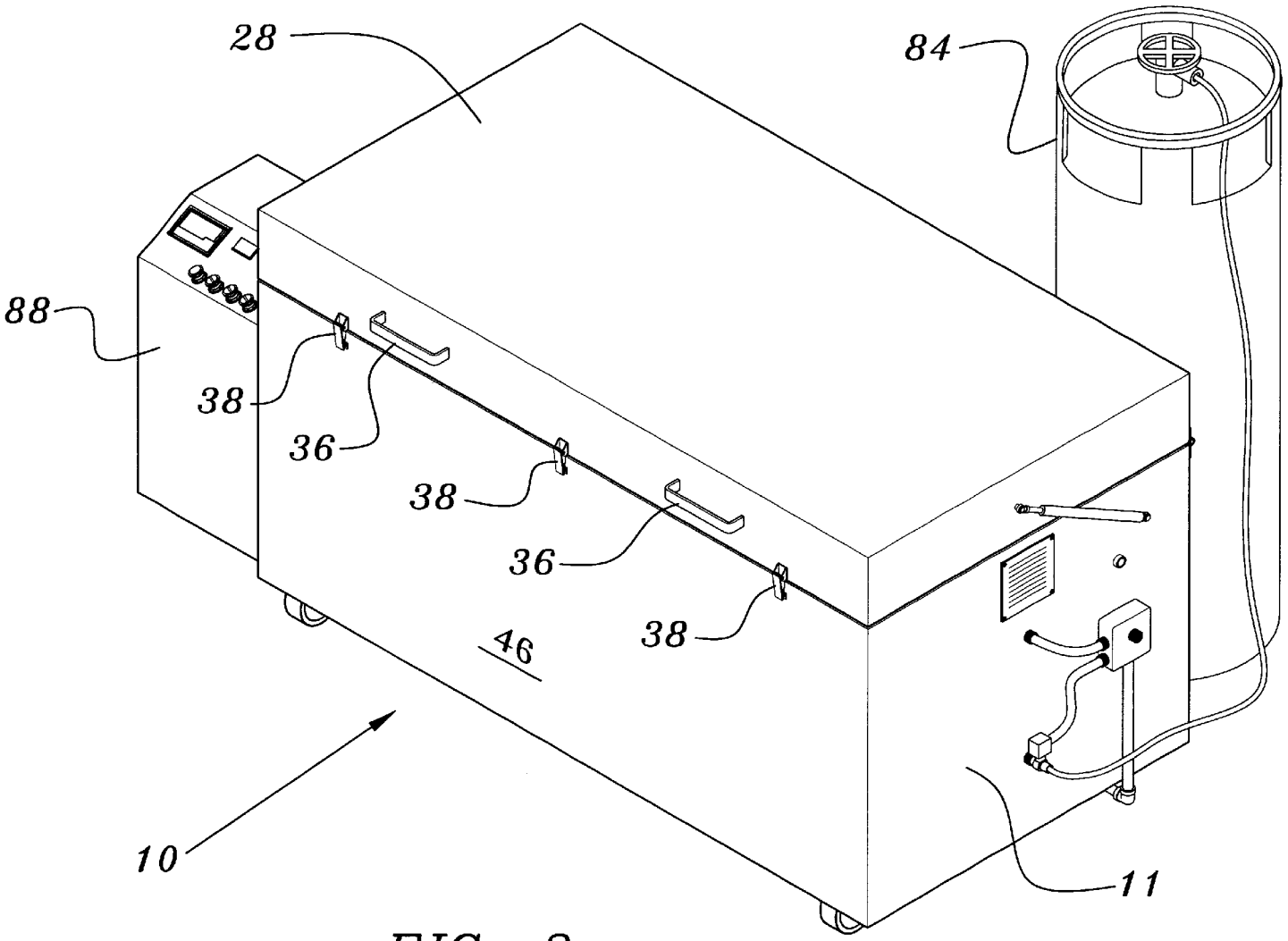
FIG. 2 is second another perspective view of the thermal cycling apparatus.
Figure 3:
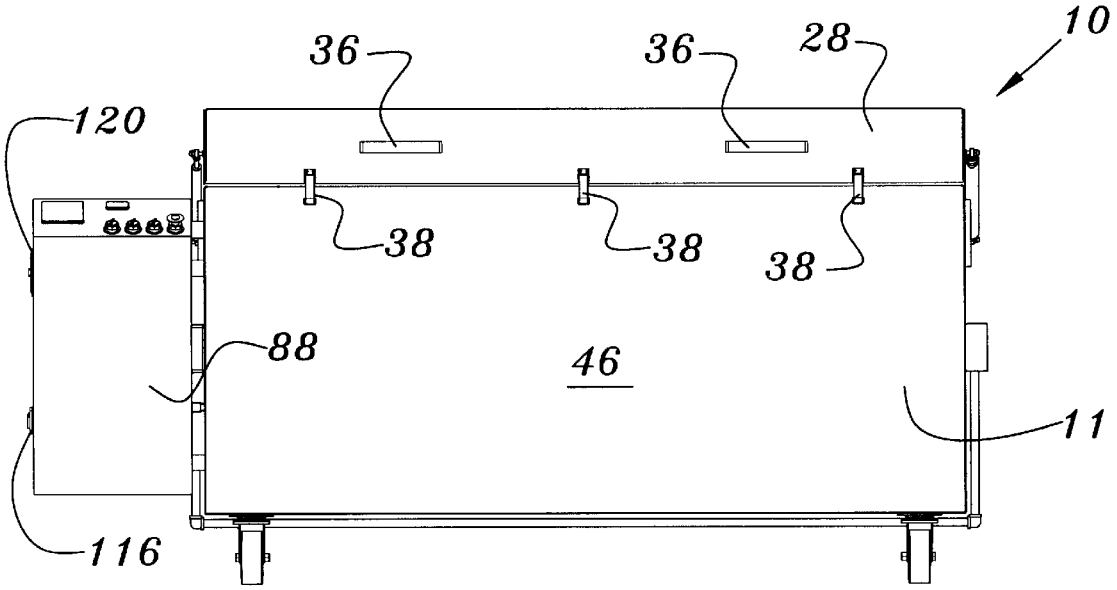
FIG. 3 is a front side view of the thermal cycling apparatus.
Figure 12:
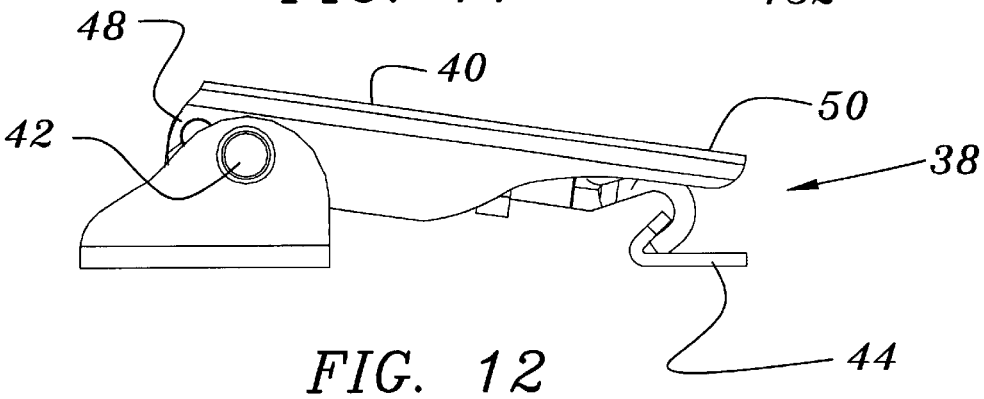
FIG. 12 is a detail view of a clasping mechanism used to secure the thermal cycling apparatus lid portion to the main tank.

With reference now to FIG. 9, it is shown that lid 28 can be positioned in an open and locked state by the use of a pair of brace members 34 (each brace member 34 positioned at opposed ends of apparatus 10). As shown in FIG. 3, lid 28 further includes a pair of handles 36 for use in opening and closing lid 28 as it pivots about hinge 30. As shown in FIGS. 1 and 2, a set of clamps 38 are used to secure lid 28 to bottom portion 11. In the preferred embodiment, three clamps 38 are employed. Each clamp 38 is adjustable thereby permitting lid 28 to expand, in response to temperature variations, during operation of apparatus 10. As shown in FIG. 12, each clamp 38 includes a plate member 40 having an upper and lower end 48 and 50 respectively. Plate member 40 pivots about a hinge portion 42 at upper end 48 and secures to a latch 44 at bottom end 50. Latch 44 mounts along an outer front wall 46 of bottom portion 11 (see FIG. 1–3).

Figure 8:
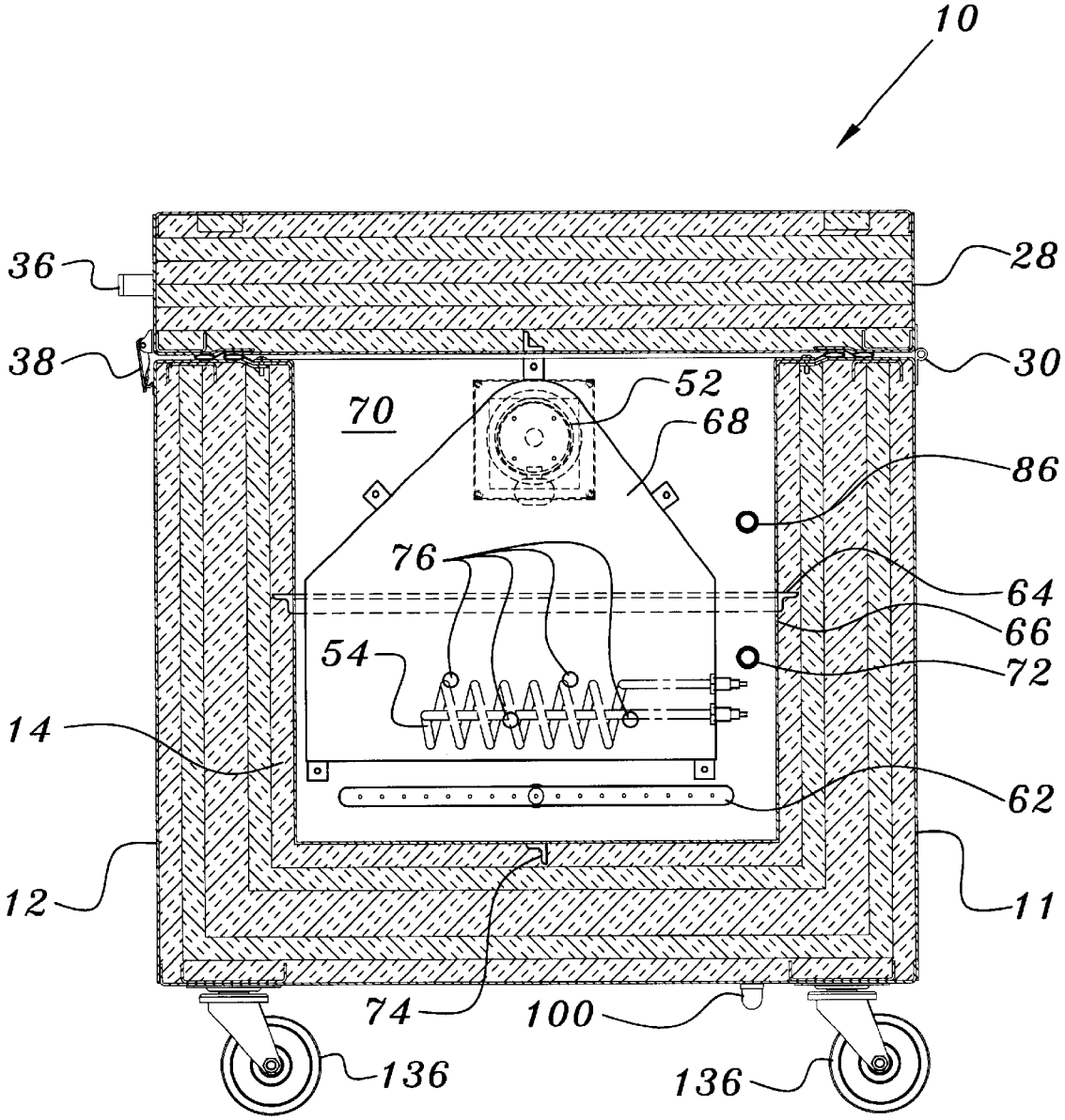
FIG. 8 is a cross-sectional view of the thermal cycling apparatus taken along lines 8—8 of FIG. 4.

As shown in FIG. 7, apparatus 10 includes a pair of fans 52, a pair of heaters 54 and a pair of sparger assemblies 62, one each mounted within inner cavity 29 at opposed ends 56 and 58. As shown in FIG. 8, a shroud 68 covers each fan 52 and heater 54 and mounts to a side wall 70 of bottom portion 11. Also shown in FIG. 8, each fan 52 mounts above each heater 54 which in turns mounts above each sparger assembly 62 along side wall 70. Each sparger assembly 62 however is mounted below and outside of each shroud 68. With reference back to FIG. 7, it is shown that each sparger assembly 62 connects to a conduit 78 that inserts through inner and outer tanks 14 and 12 respectively. A threaded coupler 80 connects to the outer end of conduit 78 further coupling to a valve 82 and a power block 96. Valve 82 connects to a liquid nitrogen (preferred) or inert gas source 84. In the preferred embodiment, sparger assembly 62 is employed as the means for introducing the source of cryogenic material into inner cavity 29. However, in an alternate embodiment, a heat exchanger could be employed. Further, as to introducing heat into inner cavity 29, the use heaters 54 is the preferred means. However, evacuation of the cryogenic material or ambient air can be used as a means to ramp the temperature of inner cavity 29 upwards.

As shown in FIG. 7, a pair of fans 52, heaters 54 and sparger assemblies 62 are employed since inner cavity 29 can be divided by an insulating barrier 60. Barrier 60 permits apparatus 10 to process either a small load which does not require the use of the entire volume of inner cavity 29 or to operate two simultaneous processes independently of each other. If one single small load is to be processed, then the left side of inner cavity 29 is used. In the preferred embodiment, a TA301 insulator is employed which is capable of withstanding temperatures of −420° to +1000° F. without expanding. Heaters 54 can have a watt density of 5 watts psi to 45 watts psi.

With reference to FIG. 8, a first tank bracing member 64 is shown horizontally disposed within inner tank 14 at about a middle portion 66 of inner tank 14. First tank bracing member 64 spans across the short length of inner tank 14 and ensures that inner tank 14 does not implode due to extreme temperature changes encountered during the cryogenic process. A second tank bracing member 74 spans across the long length of inner tank 14 and again ensures and that inner tank 14 does not implode due to extreme temperature changes encountered during the cryogenic process. In the preferred embodiment, first and second bracing members 64 and 74 are stitched welded within inner tank 14.

With continuing reference to FIG. 8, a preliminary purge valve 86 is formed through each side wall 70 of inner tank 14 and is used to rapidly evacuate air from the inner cavity 29 to the surrounding ambient air outside of apparatus 10. Disposed below each purge valve 86, also formed through each side wall 70, is a power inlet port 72 which provides a power supply connection to each heater 54 from outside of apparatus 10. Each heater 54 is disposed within shroud 68, however, a plurality of holes 76 are formed in shroud 68 directly in front each heater 54 which permits air to flow therethrough.

Referring to FIG. 1, a controller housing 88 is shown mounted along an outer left side 90 of apparatus bottom portion 11. Controller housing 88 encloses controllers and circuitry used to operate apparatus 10 and will be discussed in further detail hereinafter.

Referring to FIG. 5, a power distribution box 92 is mounted along apparatus bottom portion outer left side 90. Power distribution box 92 electrically couples to the power supply circuitry contained within controller housing 88. A power supply 94 electrically couples to the controller circuitry and supplies all power to apparatus 10. Power supply 94 can be either an AC or DC power source. Power distribution box 92 further electrically couples to the sparger assembly power block 96 mounted directly above valve 82. Finally, power distribution box 92 electrically couples to fan 52 through a port 97 formed directly below fan 52 through inner and outer tanks 14 and 12 respectively.

Referring to FIG. 6, an identical power distribution scheme is provided for the opposed side of apparatus bottom portion 11. In particular, a power distribution box 92 mounts along an outer right side 98 of apparatus bottom portion and is electrically coupled to the controller circuitry by means of a conduit 100 which runs from the power distribution box 92 mounted on apparatus bottom portion outer left side 90 underneath apparatus bottom portion 11 and up apparatus bottom portion outer right side 98 (see FIG. 7). Power is then distributed from right side power distribution box 92 to right side fan 52 through a right side port 97 and to right side sparger assembly through right side sparger assembly power block 96.

Figure 13:
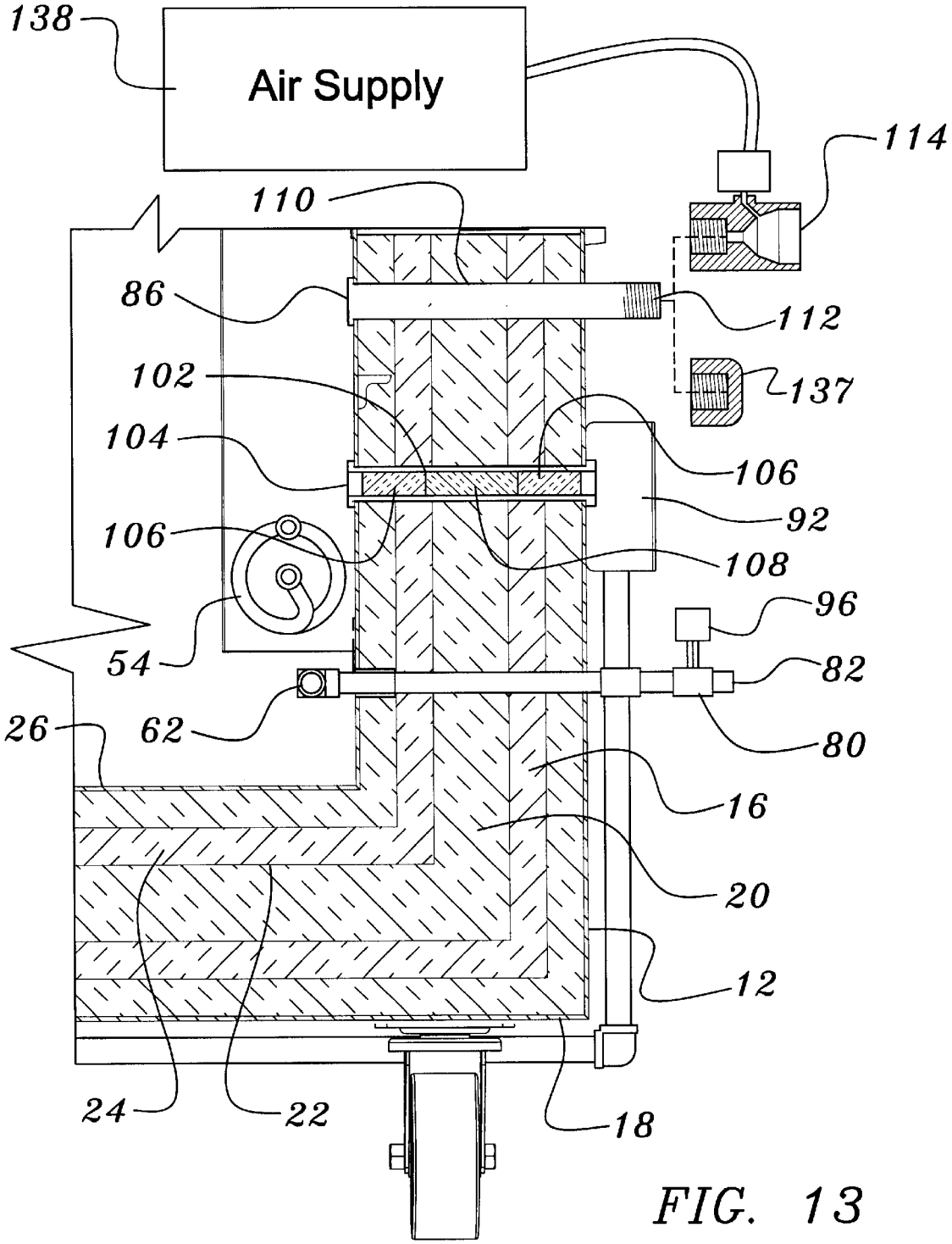
FIG. 13 is a close up detail of FIG. 7.
Figure 14:
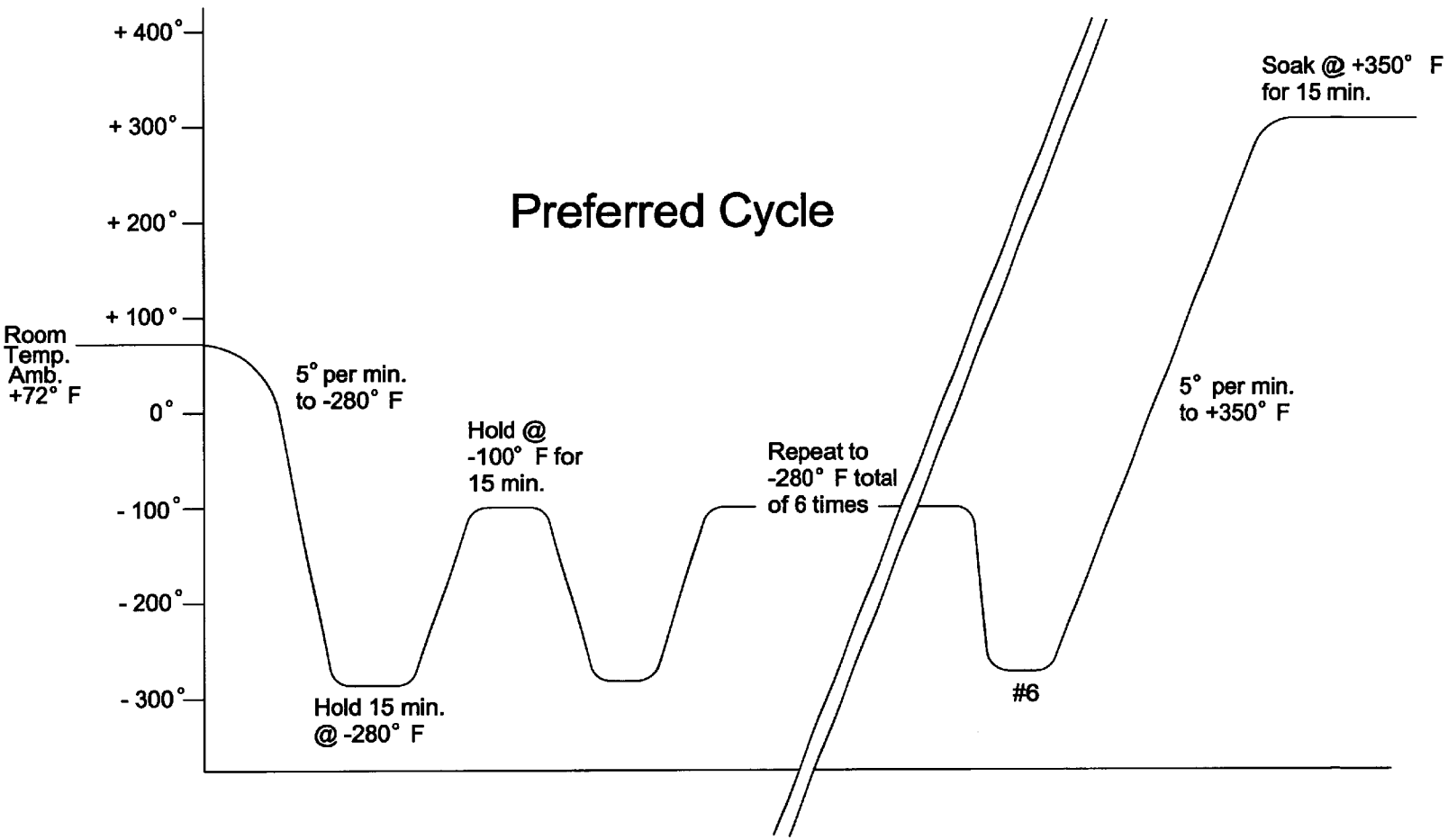
FIG. 14 is a graph illustrating the preferred cryogenic cycle used with the thermal cycling apparatus of the present: invention.

Referring to FIG. 13, a novel insulation means is shown for insulating the power supply wiring from each power distribution box 92 to each heater 54. In this novel scheme, a conduit 102 is inserted through outer and inner tanks 12 and 14 respectively. At its outer end, conduit 102 connects to power distribution box 92. At its inner end, a threaded coupler 104 is inserted thereover. Coupler 104 then connects to a flex hose which in turn connects to fan 52. Within conduit 102, insulation is packed around the power supply wires to create a hepa-seal. Proximal to both the outer and inner ends of conduit 102 is a ceramic-mix insulator 106. Disposed therebetween is a ceramic-fiber insulator 108. In the preferred embodiment, kaowool is employed. This novel insulation packing scheme ensures that no gas leaks from inner cavity 29 out through port 97 during the process, a common problem encountered in the prior art. In the preferred embodiment, 50% kaowool 108 is used in the middle of conduit 102 with 25% ceramic-mix insulator 106 surrounding the kaowool 108 on each opposed side.

As shown in FIG. 13, preliminary purge valve 86 includes a conduit 110 inserted through inner and outer tanks 14 and 12 respectively. An outer end 112 is threaded and can be closed by a cap 137 if purge valve 86 is not to be used. However, in the preferred embodiment, purge valve 86 includes a vortex valve 114 inserted over threaded outer end 112 which is capable of being opened by an air source 138 of about 300 psi. Air source 138 is controlled by the apparatus controller which is to be more fully discussed hereinafter.

Figure 11:
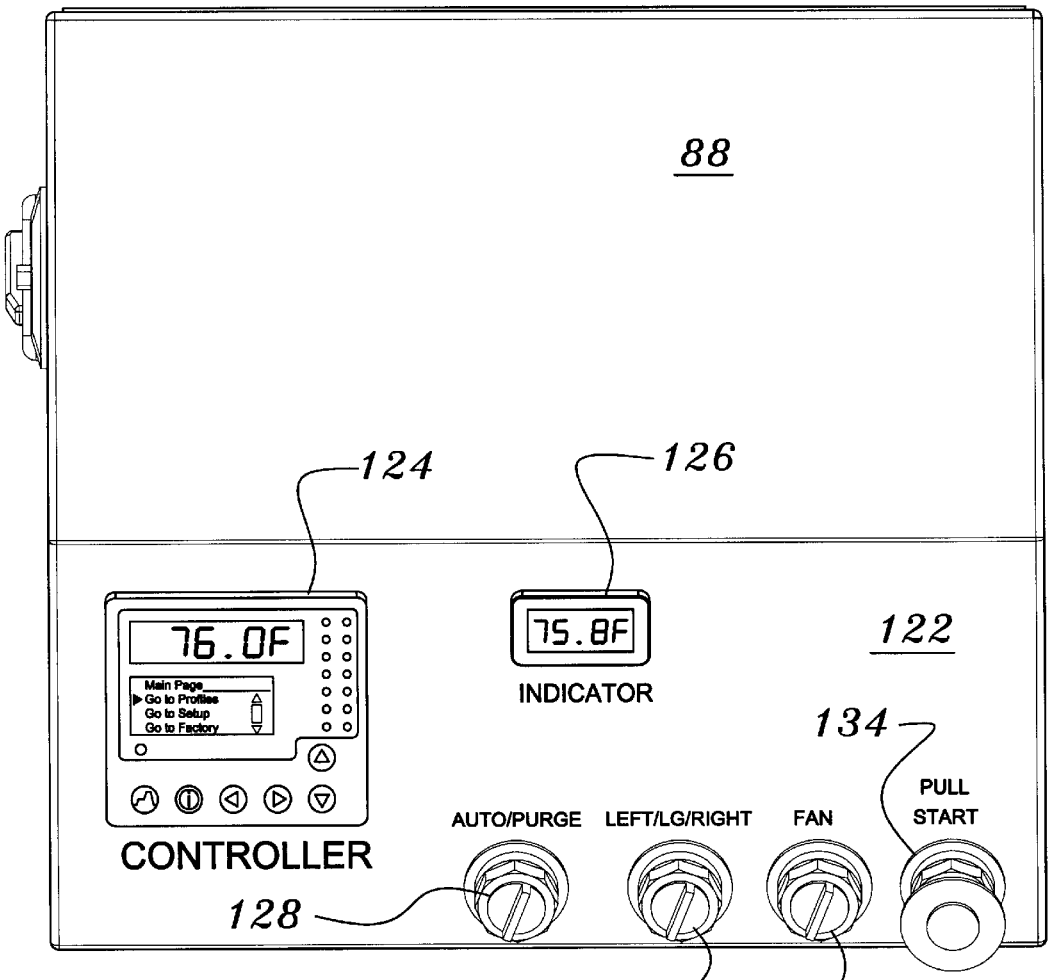
FIG. 11 is a top plan view of a controller housing used with the thermal cycling apparatus.

Referring to FIG. 1, a main power on/off switch 116 is provided along a side wall 118 of controller housing 88. Power switch 116 interrupts all power to apparatus 10 when set to the off position. Mounted directly above power switch 116, also along controller housing side wall 118, is a parallel data port 120 for use in making connection to a PC (not shown). Enclosed within controller housing 88 is controller circuitry which operates apparatus 10. Positioned along a slanted top side 122 of controller housing 88, are a plurality of controls, as shown in FIG. 11. The controls include, a key controller 124, a temperature indicator 126, an auto/purge switch 128, a left/large/right switch 130, a fan switch 132 and a pull start switch 134.

In the preferred embodiment, a Watlow F4D dual zone controller is employed for key controller 124. In a single zone apparatus, a Watlow F4S is employed for key controller 124. Further to the preferred embodiment, temperature indicator 126 is an LCD display. Auto/purge switch 128 is a dual position rotary switch. However, switch 128 requires that the user hold the switch in the purge position when purging the system of ambient air. Releasing switch 128 causes it to fall back into the auto position. Switch 130 is a three position rotary switch and permits the user to operate apparatus 10 in three separate modes. In the left position, the left side of inner cavity 29 can be programmed to carry out a first cryogenic thermal cycling process. In the right position, the right side of inner cavity 29 can be programmed to carry out a second cryogenic thermal cycling process independent of the first process being carried out in the left side. Barrier 60 must be inserted within cavity 29 to carry out a left or right side process. However, the two processes can be run simultaneously. In the large position, the entire volume of inner cavity 29 is used to carry out a single cryogenic thermal cycling process. Switch 132 is a two position rotary switch which activates fans 52 to create convention airflow (both hot and cold) inside inner cavity 29. Switch 134 is a pull knob switch and initiates a pre-programmed process of apparatus 10.

Key controller 124 has a plurality of buttons and indicators which can be used during a cryogenic thermal cycling process of the present invention. Key controller 124 includes up and down keys which moves a cursor arrow position in a lower display through software in the direction of the arrow. Accordingly, values can be increased or decreased or letters changed in user nameable fields such as alarms, events and profile names. Key controller 124 further includes left and right keys which can move the lower display menus through various choices and also to an exit point. An information key provides information in the lower display about the cursor-selected parameter. A profile key summons a menu that allows the user to start, hold, resume or terminate a profile. The lower display shows information about the setup, operation and programming of key controller 124. A profile indicator light operates as a run/hold status indicator. When lit, a ramping profile is running. When blinking, the profile is on hold. When not lit, key controller 124 operates as a static set point controller. A communication indicator light indicates communicator status and when lit (pulsating) indicates that key controller 124 is sending or receiving data. A pair of alarm indicators illuminate when key controller 124 is in an alarm state. A set of four active output indicator lights illuminate when the corresponding controller channel output is active.

As to the final structural components of apparatus 10, FIGS. 3 and 5–8 show that apparatus 10 includes a set of wheels 136 which permit a user to move apparatus 10 around a work environment. In the preferred embodiment, four swivel locking castors are employed for wheels 136.

Apparatus 10 operates a novel cryogenic thermal cycling process not seen heretofore. It is a computer controlled process that can subject articles placed within inner cavity 29 to temperatures below −330° F. and up to +500° F. Since the process is computer controlled, a precise processing profile can be achieved depending on the article being subjected to the cryogenic process. These profiles can be stored in memory for easy retrieval on key controller 124 or a PC (not shown) connected to parallel data port 120.

Apparatus 10 can treat articles of varying molecular structure. Accordingly, the profile used in operation of the process employed in apparatus 10 may vary. It is most common to treat metal articles of manufacture for which a preferred cycle exists and will be fully described hereinbelow. However, apparatus 10 can treat a variety of articles as previously disclosed. And therefore, a plurality of methods exist which include different ranges of temperatures, soak times, and the number of ramping thermal cycles.

Typically, most articles begin the cryogenic process at ambient room temperature which is usually around 70–75° F. If the article is made of metal it is first wrapped in aluminum foil. With lid 28 open, the article(s) is placed into inner cavity 29 of apparatus 10. Depending on the load size, switch 130 is either set to left, right or large. If the load is left or right, then barrier 60 is inserted into inner cavity 29. All power connections are confirmed for proper connection. Power switch 116 is then turned to its on position thereby applying power to apparatus 10. If a pre-programmed profile is to be used, it is brought up from memory either stored in key controller 124 or from a PC connected to data port 120. If a new profile is to be used, it is programmed using the various buttons located on key controller 124 or by use of the PC. Next, lid 28 is shut but not yet secured closed using clamps 38. Thereafter, the source of cryogenic material is connected to valve 82 and permitted to flow freely from its holding tank. Next, switch 128 is turned and held in the "purge" position to evacuate the ambient air (oxygen) present within inner cavity 29 while injecting the cryogenic material (nitrogen). The purging step, which could take up to two minutes, removes moisture from inner cavity 29 and ensures that the article will not rust (if treating a metal article). Once the ambient air is evacuated, clamps 38 are latched shut to completely secure lid 28 to bottom portion 11 of apparatus 10. Since the programmed profile will control fans 52, it is merely confirmed that fan switch 132 is in its "on" position. Finally, pull-start switch 134 is pulled outward initiating the process profile.

The article is first subjected to a negative Fahrenheit temperature which is typically brought down no lower than −320° F. (the temperature at which nitrogen transforms from a gaseous to a liquid state). The temperature however is at least brought down to a shallow cryogenic temperature of −80° F. It can be brought down at a rate of 0.1° to 100° F. per minute. Once reaching the target temperature, the article is soaked from 1 second to 24 hours. Thereafter, the temperature is increased (ramped upwards) but only to a level somewhere below 0° F. There, the article is allowed to soak for another 1 second to 24 hours. The rate of temperature change can again be between 0.1° to 100° F. per minute. The temperature is again brought back down to around −320° F. and allowed to soak for 1 second to 24 hours. This cycling process can be repeated indefinitely but does not require more than a first cycle. Since many of the soak times can be long however, it is unlikely that the cycling would exceed twenty-five cycles. After completely the last cycle, the temperature of inner cavity 29 is brought up to a positive Fahrenheit temperature somewhere between ambient room temperature to about +350° F. There, it is allowed to soak between 1 second and 24 hours. The temperature is again ramped at a rate of 0.1° to 100° F. Finally, the article temperature is brought back down to ambient room temperature and thereafter removed from inner cavity 29 of apparatus 10.

In a preferred method, the article is placed into inner cavity 29 as described above. All preliminary steps, as set forth above, are carried out. The preferred profile is then chosen which practices the following steps. The article is brought down to −280° F. at a rate of 5° F. per minute and soaked for fifteen minutes. Thereafter, the temperature is ramped up to −100° F. at a rate of 5° F. per minute and soaked for fifteen minutes. A total of five cycles following this profile is carried out. After the fifth cycle, the temperature is ramped down to −280° F., soaked for fifteen minutes and then ramped up to +350° F. at a rate of 5° F. minute and held there for fifteen minutes. Finally, the article is allowed to cool to ambient room temperature by running fans 52 and or opening lid 28.

Equivalent elements can be substituted for the ones set forth above such that they perform the same function in the same way for achieving the same result. Further, equivalent steps for the novel method of the present invention can be substituted for the ones set forth above such that the method performs the same function in the same way thereby achieving the same result.

Having thus described the invention what is claimed and desired to be secured by Letters Patent is:

1. An apparatus for strengthening an article of manufacture by a cryogenic process, a source of cryogenic material connected to the apparatus, the apparatus comprising:

a) a bottom portion having a means for prohibiting thermal conduction disposed between an outer and inner shell and defining an inner cavity, the article of manufacture disposed within the inner cavity during the cryogenic process;

b) a lid mating with the bottom portion for sealing the inner cavity from ambient air;

c) means for connecting to an electrical power supply;

d) means for preventing thermal conduction between the inner and outer shells during the cryogenic process disposed between the bottom portion and the lid when the lid seals the inner cavity;

e) means for evacuating ambient air from within the inner cavity when the lid seals the inner cavity;

f) means for introducing the source of cryogenic material into the inner cavity;

g) means for introducing heat into the inner cavity;

h) means for providing airflow convection within the inner cavity; and i) means for controlling a profile of the cryogenic process.

2. The apparatus of claim 1, further comprising:

a) at least one hinge connecting a lower back side edge of the lid to an upper back side edge of the bottom portion;

b) at least one clamp for securing the lid to the bottom portion; and c) a pair of bracing members disposed at opposed side walls of the apparatus to hold the lid in an open and locked position.

3. The apparatus of claim 1, wherein the bottom portion outer shell defines an outer tank and the bottom portion inner shell defines an inner tank, the means for prohibiting thermal conduction comprising a plurality of insulating layers disposed between the outer and inner tanks.

4. The apparatus of claim 3, wherein the plurality of insulating layers comprises:

a) at least one layer of blueboard juxtaposed a stainless steel shell of the outer tank;

b) a layer of foam juxtaposed the at least one layer of blueboard;

c) a layer of aluminum tape juxtaposed the layer of foam;

d) a layer of ceramic-fiber insulation juxtaposed the layer of aluminum tape; and e) a stainless steel shell of the inner tank juxtaposed the layer of ceramic fiber insulation.

5. The apparatus of claim 1, wherein the lid comprises an outer and inner shell and a means for prohibiting thermal conduction disposed therebetween.

6. The apparatus of claim 1, further comprising:

a) the bottom portion having opposed left and right outer side walls;

b) a controller housing mounted along the bottom portion left outer side wall, the controller housing enclosing a plurality of electrical components that comprise the means for controlling a profile of the cryogenic process, and c) the means for connecting to an electrical power supply electrically coupled to the plurality of electrical components that comprise the means for controlling a profile of the cryogenic process.

7. The apparatus of claim 1, wherein the means for preventing thermal conduction between the inner and outer shells comprises a pair of bead members, one each mounted on the lid and the bottom portion.

8. The apparatus of claim 1, wherein the means for introducing the source of cryogenic material into the inner cavity is at least one sparger assembly mounted within the bottom portion inner cavity, the at least one sparger assembly coupled to the source of cryogenic material.

9. The apparatus of claim 1, wherein the means for introducing heat into the inner cavity is at least one heater mounted within the bottom portion inner cavity.

10. The apparatus of claim 1, wherein the means for providing airflow convection within the inner cavity is at least one fan mounted within the bottom portion inner cavity.

11. The apparatus of claim 1, wherein the means for controlling a profile of the cryogenic process is capable of automatically operating the means for evacuating ambient air from within the inner cavity, the means for introducing the source of cryogenic material into the inner cavity, the means for introducing heat into the inner cavity and the means for providing airflow convection within the inner cavity.

12. The apparatus of claim 1, further comprising a bracing means mounted within an outer surface of the apparatus for prohibiting the implosion of the bottom portion inner shell.

13. The apparatus of claim 12, wherein the bracing means comprises:

a) a first bracing member supporting a short span of the inner cavity; and b) a second bracing member supporting a long span of the inner cavity.

14. An apparatus for realigning a molecular structure of an article of manufacture by a cryogenic process, a source of cryogenic material connected to the apparatus, the apparatus comprising:

a) a bottom portion having a plurality of insulating layers disposed between an outer and inner tank, the inner tank defining an inner cavity, the article of manufacture disposed within the inner cavity during the cryogenic process;

b) a lid mating with the bottom portion for sealing the inner cavity from ambient air;

c) an electrical connection to a power supply;

d) a pair of bead members, one each mounted on the lid and the bottom portion, the pair of bead members preventing thermal conduction from the inner tank and inner cavity out to the ambient air through the outer tank and the lid;

e) at least one cryogenic material deployment unit mounted within the inner cavity and coupled to the source of cryogenic material;

f) at least one heater mounted within the inner cavity for ramping the temperature within the inner cavity upwards;

g) at least one fan mounted within the inner cavity for providing airflow convention thereto;

h) a controller unit electrically coupled to the apparatus for controlling a programmed cryogenic process profile; and i) means for evacuating ambient air from within the inner cavity when the lid seals the inner cavity.

15. The apparatus of claim 14, further comprising:

a) a continuous hinge connecting the bottom portion to the lid;

b) a set of clamps mounted along a front side of the lid for mating with a set of reciprocal latches mounted along a front side of the bottom portion outer tank;

c) a pair of bracing members disposed at opposed sides of the apparatus for holding the lid in an open and locked position; and d) a pair of handles mounted along the front side of the lid for pivoting the lid upon the continuous hinge.

16. The apparatus of claim 14, wherein the plurality of insulating layers comprises:

a) at least one layer of blueboard juxtaposed a stainless steel shell of the outer tank;

b) a layer of foam juxtaposed the at least one layer of blueboard;

c) a layer of aluminum tape juxtaposed the layer of foam;

d) a layer of ceramic-fiber insulation juxtaposed the layer of aluminum tape; and e) a stainless steel shell of the inner tank juxtaposed the layer of ceramic fiber insulation.

17. The apparatus of claim 14, wherein the lid comprises an outer and inner shell and a plurality of insulating layers disposed therebetween.

18. The apparatus of claim 14, further comprising a removable insulating barrier for dividing the inner cavity into a pair of separated smaller cavities, each separated smaller cavity capable of operating an independent cryogenic process.

19. The apparatus of claim 18, further comprising:

a) the inner cavity having a rectangular shape and including a pair of opposed inner side walls;

a) the at least one cryogenic material deployment unit comprising a pair of sparger assemblies, one each mounted on the inner cavity opposed inner side walls;

b) the at least one heater comprising a pair of heaters, one each mounted on the inner cavity opposed inner side walls; and c) the at least one fan comprising a pair of fans, one each mounted on the inner cavity opposed inner side walls.

20. The apparatus of claim 19, further comprising a pair of shrouds, one each mounted on the inner cavity opposed inner side walls such that each shroud covers one fan and one heater, each shroud having a plurality of holes formed therein directly in front of each heater.

21. The apparatus of claim 14, further comprising a pair of bracing members, a first bracing member supporting a short span of the inner cavity and a second bracing member supporting a long span of the inner cavity.

22. A cryogenic process for strengthening a mass of an article of manufacture, the cryogenic process conducted in an apparatus having a submersion tank, a lid for sealing the submersion tank, a cryogenic material source supply means, an electrical power supply and a cryogenic process controller means, the apparatus connected to a source of cryogenic material, the cryogenic process comprising the steps of:

a) placing the article within the apparatus submersion tank at ambient room temperature;

b) shutting the apparatus lid to seal the submersion tank;

c) introducing the cryogenic material into the submersion tank through the cryogenic material source supply means such that the submersion tank temperature ramps down to a first target temperature of at least −80° Fahrenheit at a first temperature ramp rate;

d) permitting the article to soak at the first target temperature for a first period of time;

e) ramping the temperature of the submersion tank up to a second target temperature not to exceed 0° Fahrenheit at a second temperature ramp rate;

f) permitting the article to soak at the second target temperature for a second period of time;

g) cycling the submersion tank temperature between the first and second target temperatures at least one additional time at the first and second temperature ramping rates and the first and second period of soak times;

h) ramping the temperature of the submersion tank up to a third target temperature of at least ambient room temperature at a third temperature ramp rate;

i) permitting the article to soak at the third target temperature for a third period of time; and j) permitting the article to return to ambient room temperature.

23. The method of claim 22, wherein the cryogenic material is chosen from the group including liquid nitrogen, helium, argon and neon.

24. The method of claim 22, wherein the article of manufacture is chosen from the group including ferrous and non-ferrous metals and alloys, carbides, nylons, polymers, and ceramics.

25. The method of claim 22, wherein the first, second and third temperature ramp rates range between 0.1° and 100° Fahrenheit per minute.

26. The method of claim 22, wherein the first, second and third periods of times for soaking range between 1 second and 24 hours.

27. The method of claim 22, wherein the first target temperature ranges between −240° and −320° Fahrenheit, the second target temperature ranges between −100° and 0° Fahrenheit and the third target temperature ranges between ambient room temperature and +500° Fahrenheit.

28. The method of claim 22, wherein prior to introducing the cryogenic material into the submersion tank, further comprising the steps of:

a) providing a submersion tank air evacuating means; and b) activating the submersion tank air evacuating means thereby evacuating all ambient air from within the submersion tank.

29. A method of strengthening a metal article of manufacture through a cryogenic process, the steps of the method comprising:

a) subjecting the article to a cryogenic material such that the temperature of the article is ramped down from an ambient room temperature to a first target temperature of −280° Fahrenheit at a rate of 5° Fahrenheit per minute;

b) soaking the article at the first target temperature for fifteen minutes;

c) ramping the temperature of the article up to a second target temperature of −100° Fahrenheit at a rate of 5° Fahrenheit per minute;

d) soaking the article at the second target temperature for fifteen minutes;

e) cycling the article four more times between the first and second target temperatures at a rate of 5° Fahrenheit per minute and permitting the article to soak for fifteen minutes each time the article reaches either the first or second target temperature;

f) ramping the temperature of the article back down to the first target temperature of −280° Fahrenheit at a rate of 5° Fahrenheit per minute;

g) soaking the article at the first target temperature for fifteen minutes;

h) ramping the temperature of the article up to a third target temperature of +350° Fahrenheit at a rate of 5° Fahrenheit per minute;

i) soaking the article at the third target temperature for fifteen minutes; and j) permitting the article to return to ambient room temperature.

* * * * *